United States Patent [19]

Fieldhouse

[11] 3,960,199

[45] June 1, 1976

[54] EXPANSIBLE FRAME HOT TOPPING APPARATUS WITH WEDGE INSERTION MEANS

[75] Inventor: Roger Fieldhouse, Birmingham, England

[73] Assignee: Foseco Trading A.G., Chur, Switzerland

[22] Filed: Dec. 13, 1974

[21] Appl. No.: 532,690

[30] Foreign Application Priority Data

Dec. 21, 1973 United Kingdom ..... 59555/73

[52] U.S. Cl. ..... 164/339

[51] Int. Cl.[2] ..... B22D 33/00; B22D 45/00

[58] Field of Search ..... 164/339, 137

[56] References Cited

UNITED STATES PATENTS 3,815,664 6/1974 Eccleston et al. ..... 164/339

*Primary Examiner*—Robert D. Baldwin

*Attorney, Agent, or Firm*—Cushman, Darby & Cushman

[57] ABSTRACT

The disclosure relates to apparatus for applying a hot top lining in an ingot mould or ingot mould head box. The apparatus comprises a pair of slab support members each having two faces adapted to support an L-shaped slab of hot top lining material such that the L-shaped slabs are supported outside the members in the form of a rectangle, means for moving the members towards one another and apart to decrease or increase the size of the rectangle, supports for corner wedges located above the gap between supported L-shaped slabs when the members are in their most separated position, means for releasing corner wedges from such supports, and means for applying pressure to the tops of the corner wedges to urge them into the gaps between the L-shaped slabs.

7 Claims, 4 Drawing Figures

EXPANSIBLE FRAME HOT TOPPING APPARATUS WITH WEDGE INSERTION MEANS

This invention relates to apparatus for hot topping ingot moulds.

In casting molten metal to form ingots it is customary to provide, at or near the top of the ingot mould, an internal lining of heat-insulating material. This serves to keep the head metal molten for some time after pouring and so allow feed of molten metal to the body of the ingot to compensate for shrinkage on solidification.

This lining is known as a hot top lining and it may be located at the top of the mould or in a head box which is superimposed on a mould body in use.

Many types of apparatus have been developed for applying hot top linings. One such is described in British patent specification No. 1,359,731. This apparatus has the disadvantage of substantial bulk and, as a result, it is difficult to manoeuvre and handle. Also where the mould contour is irregular, such as occurs, for example, where they are eroded, satisfactory lining has been found difficult to achieve.

According to the present invention there is provided apparatus for applying a hot top lining in an ingot mould or ingot mould head box which comprises a pair of slab support members each having two faces adapted to support an L-shaped slab of hot top lining material such that the L-shaped slabs are supported outside the members in the form of a rectangle, means for moving the members towards one another and apart to decrease or increase the size of the rectangle, supports for corner wedges located above the gap between supported L-shaped slabs when the members are in their most separated position, means for releasing corner wedges from such supports, and means for applying pressure to the tops of the corner wedges to urge them into the gaps between the L-shaped slabs.

In use, such apparatus is loaded with two L-shaped slabs and two corner wedges. At this stage, the members are in their closest together position and the wedges are held generally above the corners where the L-shaped slabs meet. The so-loaded apparatus is then lowered into an ingot mould or head box and the two members moved apart: this pushes the two L-shaped slabs into two of the corners of the mould or head box leaving two gaps at the other two corners for the receipt of the wedges. At the same time, since the outward movement engages the slabs and supports with the mould or head box walls, it fixes the whole apparatus firmly in the mould or head box. The corner wedges are now released, upon which they drop vertically into the two gaps at the two opposite corners. Thereafter, pressure is applied to the corner wedges to force them down into the gaps between the L-shaped slabs and thus fix those slabs firmly in the mould or head box. The pair of members is now moved together again, leaving the slabs and wedges firmly set in place and the apparatus withdrawn.

Clearly a wide variety of mechanical linkages may be used to achieve the desired effects. Conveniently, the apparatus is operated by hydraulic or pneumatic cylinders.

Preferably the slab support members in the apparatus of the invention are adapted to allow the hot top lining slabs to sit firmly against the walls of the mould or the head box even where the internal geometry of the ingot mould or ingot mould head box is irregular. Thus each slab support member may comprise a substantially L-shaped member mounted pivotally about a vertical axis; this ensures that in use the L-shaped slab is pressed evenly against both walls which it contacts.

In order to prevent the hot top lining slabs fouling the top of the mould accidentally as the apparatus is lowered in, which could lead to damage to the slabs, and in order to facilitate guiding the apparatus into the mould, the lower portion of the apparatus preferably includes guide members, usually in the form of a diagonally split pyramid, with its apex downwards. Each half of the pyramid may be associated with one support member, and the flat, upwardly facing base of the pyramid halves may serve to help support the L-shaped slabs. If desired, in order to reduce the overall height of the apparatus, and to enable it to be stood upright, the pyramid may be truncated; in such a case, the remaining sloping walls of the pyramid halves still serve to guide the apparatus into the mould or head box, but the absence of an apex enables the apparatus to be stood up on a flat surface.

In order to ensure optimum fitting of the pyramid halves in the mould or head box to be lined, each half is preferably also mounted pivotally about a vertical axis. The pyramid halves must also be so shaped and mounted that they can be drawn together, when the support members are moved together, to such an extent as to allow them to pass through the inserted lining to enable removal of the apparatus from the mould or head box after use.

In one preferred embodiment castors are provided on the apparatus in such a position that when the apparatus has been lowered into the mould or head box the castors rest on the mould or head box rim and support the apparatus firmly while enabling it to move freely in a horizontal plane. This facilitates accurate alignment of the apparatus in the mould; as the slab support members move apart the whole apparatus may twist or move sideways, rolling on the castors, to the optimum position.

The invention is further illustrated, by way of example, in the accompanying drawings in which FIG. 1 is a perspective view of part of an apparatus according to the invention:

Figure 3:
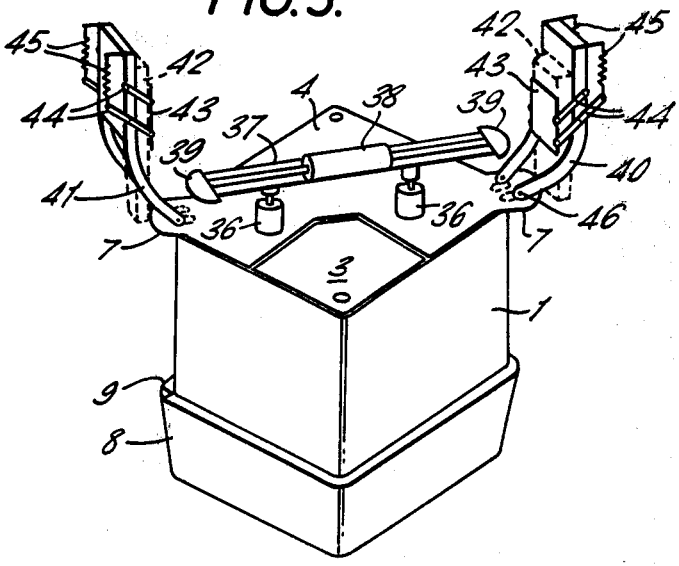
FIG. 3 is a perspective view similar to FIG. 1 but turned through 90° and showing the parts of the apparatus for inserting the wedges and FIG. 4 shows a section through a mould or mould head into which an apparatus according to the invention has been inserted.
Figure 2:
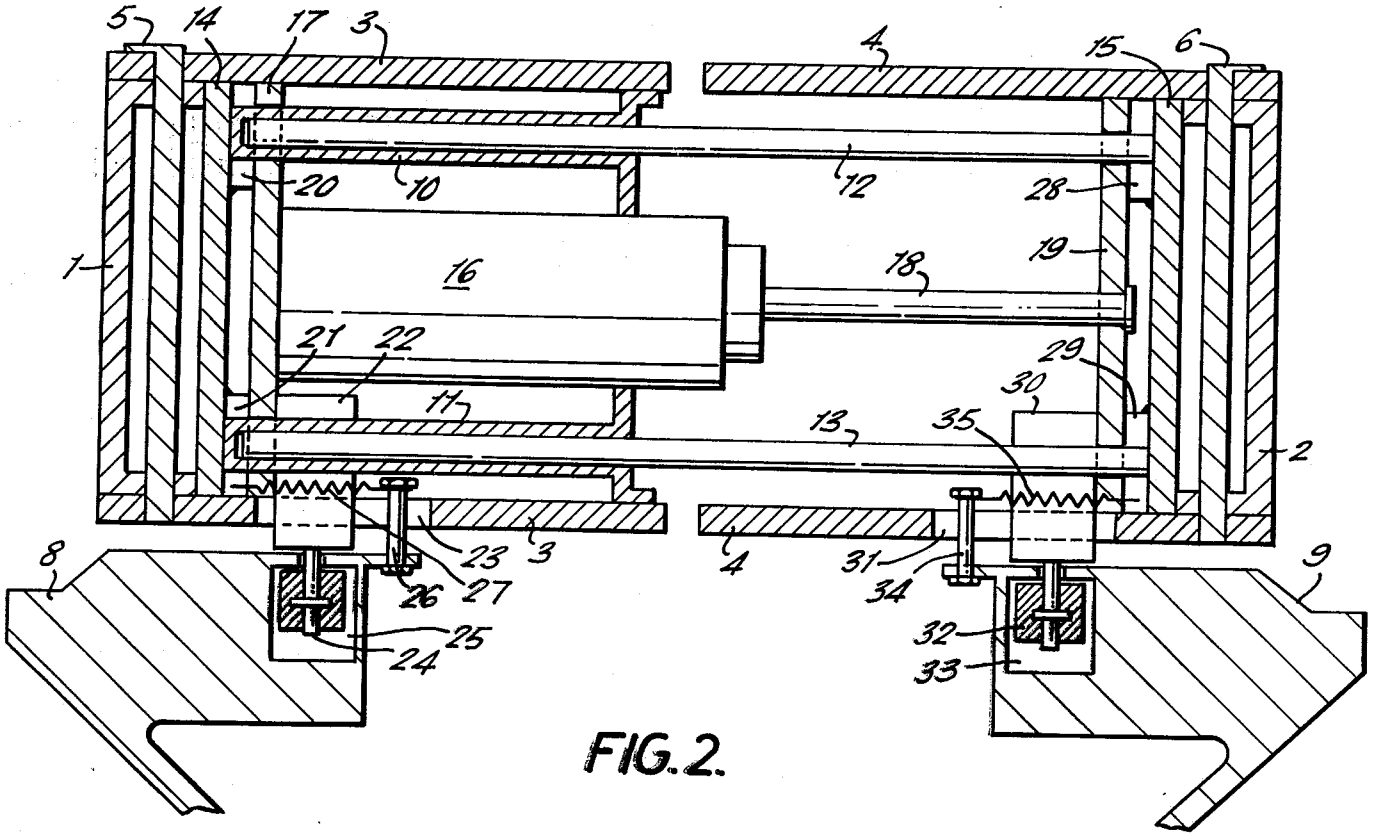
FIG. 2 is a section diagonally through the apparatus of FIG. 1 and showing the members moveable towards and apart from one another and their operating mechanism.

Various fluid actuated piston/cylinder devices are shown in FIGS. 2 and 3 of the drawings but, for the sake of clarity, all connections thereto are omitted. All the piston/cylinder devices can be operated to move the piston in either direction in the cylinder by feed of compressed gas or fluid thereto.

Figure 1:
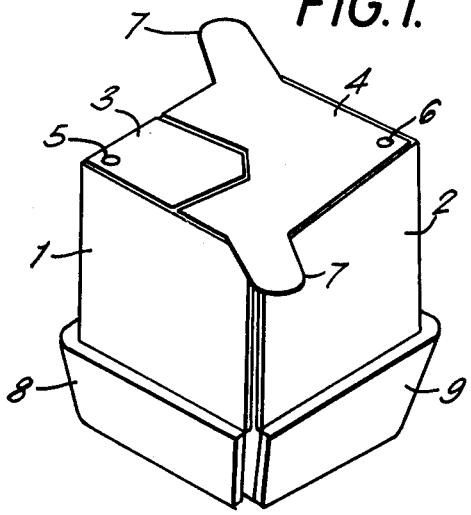

Referring first to FIG. 1 there is shown the relative configuration of the two slab support members and their mountings. For the sake of simplicity all the operating mechanism has been omitted. The apparatus comprises two L-shaped slab support members 1 and 2, each of which is pivotally mounted on one of two frame sections 3, 4 by means of a rod 5, 6. For reasons of convenience in supporting the various operating mechanisms of the apparatus and supporting the apparatus itself, the two frames 3 and 4 are of unequal size. As shown in FIG. 1, they are designed to fit together with the larger frame section 4 having projections 7 for supporting corner wedge supports (not shown in FIG. 1). Two base cones 8 and 9, together constituting a split truncated apex down pyramid, are hung from frames 3 and 4.

In horizontal section the outer contour of the slab support members 1 and 2 is a rectangle. Thus an L-shaped slab of heat insulating material may be placed on each support member, if desired resting on the upper flat surface of its associated base cone, so that the two slabs together form a rectangle.

With reference to FIG. 2, frames 3 and 4 comprise members which are telescoped together; frame 3 includes sleeves 10 and 11 and frame 4 includes rods 12 and 13 which engage suitably in the sleeves. Base cones 8 and 9 are slung from frames 3 and 4 on a pivotal mounting described in further detail below. In FIG. 2 the apparatus is shown in the position in which frames 3 and 4 are in their closest possible position.

The L-shaped slab support member 1 is pivotally mounted on the corner of frame 3 by means of rod 5. Inside support member 1 is mounted an inner L-shaped member 14 to which are secured the sleeves 10 and 11.

In a similar way the second L-shaped slab support member 2 is pivotally mounted on frame 4, at its corner opposite rod 5 of member 1, by means of rod 6. Also inside support member 2 is mounted an inner member 15 to which are secured rods 12 and 13.

Between frames 3 and 4 is a piston/cylinder 16 which is fixed at one end to a member 17 slidably mounted within frame 3 around sleeves 10 and 11. Piston/cylinder 16 is connected via a piston rod 18 to a further slidably mounted member 19 slidably mounted within frame 4, around rods 12 and 13.

In the gap between members 14 and 17 and around sleeves 10 and 11 are further sleeves 20 and 21. These further sleeves are welded to member 14. Also surrounding sleeve 11 is a slidable sleeve 22. Sleeve 22 has a depending portion which passes through a slot 23 in frame 3. On a pivot pin 24 extending from sleeve 22 is hung the base cone 8. The pin 24 extends into a groove 25 in base cone 8. A bolt 26 extends from base cone 8 through slot 23 in frame 3. A tension spring 27 joins the head of bolt 26 to sleeve 21, than urging the sleeve 22 against member 17.

The structure of frame 4 and its base cone 9 is similar to that of frame 3 and cone 8: in the gap between members 15 and 19 and around rods 12 and 13 are sleeves 28 and 29 welded to member 15. Part of the lower rod 13 is surrounded by a slidable sleeve 30 having a depending portion which passes through a slot 31 in frame 4. From a pivot pin 32 extending from sleeve 30 is hung the base cone 9, the pin 32 extending into a groove 33 in cone 9. A bolt 34 extends from cone 9 through slot 31 in frame 4. A tension spring 35 joins the head of bolt 34 and sleeve 29, thus urging sleeve 30 towards member 19.

Referring now to FIG. 3, support member 1, frames 3 and 4 and base cones 8 and 9 can be seen. Mounted on frame 4 is a pair of piston/cylinder devices 36 which support a bar 37. Centrally mounted on bar 37 is a double piston/cylinder device 38, the piston rods of which each bear at their ends prober plates 39. The piston rods are suitably guided, e.g., by brackets affixed to bar 37.

Affixed to each of projections 7 of frame 4 is a wedge support unit 40, 41. In each of these, a corner wedge 42 of refractory heat insulating material may be held by a plate 43 which is biased against the wedge by means of a parallelogram linkage 44 and springs 45. Support unit 40 is fixed to its projection 7 of frame 4 via a hinge linkage 46 which allows unit 40 to be swung upwards during loading of the device.

Figure 4:
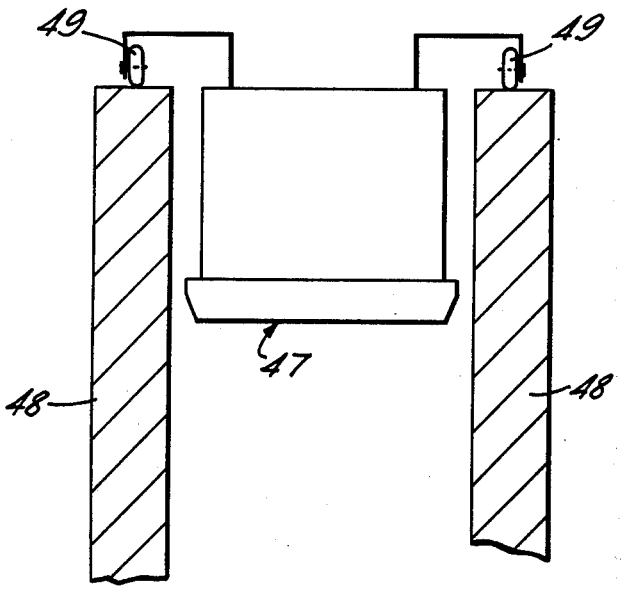

With reference to FIG. 4, an apparatus according to the invention shown diagrammatically at 47 is within a mould 48. Attached to frame 4 of the apparatus (not shown) is a support frame bearing four castors 49 — one on each side of the apparatus. When the apparatus is lowered into the mould these castors 49 rest on the tops of the four mould walls.

The apparatus is used as follows: at a loading station away from the mould two L-shaped slabs of heat insulating material are put on slab support members 1 and 2 such that the slabs are in the form of a rectangle and corner wedges 42 are inserted as shown. The L-shaped slabs may rest on the base cones and be retained by latches mounted on top of frames 3 and 4 which lift on contact with the top of the mould walls when the apparatus is lowered to release the slabs. To insert the wedges, the operator stands next to wedge support unit 41 and swings support unit 40 about hinge 46 to enable easy insertion of the wedge 42.

With frames 3 and 4 telescoped together and with the apparatus in the position shown in FIG. 2, the loaded apparatus is lowered, e.g., suspended from a suitable crane or gantry, into the ingot mould head it is desired to line. If the apparatus has castors 49, as shown in FIG. 4, when the apparatus is lowered the castors come to rest on the side walls of the mould and steady the apparatus in the mould.

When the apparatus has been lowered piston/cylinder 16 is expanded to force apart the two frames 3, 4 each carrying a slab supporting member 1 or 2 and a heat insulating slab 8, 9. The expanding piston/cylinder 16 and its rod 18 push apart the slidable members 17 and 19. Member 17 is in contact with sleeves 20 and 21 secured to member 14 fixed to frame 3. Similarly in frame 4, member 19 is in contact with sleeves 28 and 29 secured to fixed member 15. Thus the two frames 3, 4 and the base cones 8, 9 (pulled along via springs 27 and 35) are forced apart, the rods 12 and 13 sliding in sleeves 10 and 11.

This is continued until the leading edges of both base cones 8 and 9 contact the mould walls and fit into position, pivoting on their supports. At this point the base cones will move no further outwards; however, continued expansion of piston/cylinder 16 forces frames 3 and 4 further apart against the action of tension springs 27 and 35 attached to base cones 8 and 9. If the apparatus comprises castors 49, as shown in FIG. 4, these roll along the top of mould walls as the two frames move apart to set the apparatus optimally in the mould.

Expansion of piston/cylinder 16 continues until the L-shaped heat insulating slabs on support members 1 and 2 are pressed firmly against the mould walls. As the slabs come into contact with the mould walls any inaccurate alignment in the apparatus within the mould and any irregularity in the geometry of the mould is compensated for by pivoting of support members 1 and 2 about their respective rods 5 and 6. In this way the apparatus itself is self-aligning and it can be ensured that the slabs of insulating material are held tightly and squarely up against the mould wall.

The two corner wedges 42 are now released from their support units 40 and 41 above the gaps between the ends of the L-shaped slabs. The wedges 42 are released by plates 43 being lifted by means of beam 37 and pressure plates 39 whereupon the wedges 42 drop into the two gaps between the ends of the L-shaped insulating slabs. Beam 37 is then raised further by piston/cylinder 36 and piston/cylinder device 38 is then actuated to force outwards pressure plates 39 on bar 37 so that the pressure plates take positions over wedges 42. Then piston/cylinders 36 are actuated to lower the bar 37. During this lowering the plates 39 engage the tops of wedges 42 and press them firmly into the gaps wedging the mould lining in place. The frame of the apparatus does not rise during this wedging because it is firmly held in expanded condition in the mould head by means of piston/cylinder 16.

If desired the bar joining the pressure plates 39 may be pivotally mounted on the tops of the piston rods of piston/cylinders 36 so that the corner wedges may be pressed down to different levels. In this way irregularities in the mould or lining may be further compensated for.

Thereafter the apparatus is removed from the mould to leave the 2-slab-2-corner wedge lining firmly in place. This is achieved as follows: the piston/cylinder device 16 is retracted. Retraction of piston/cylinder device 16 causes slidable member 17 and thus sleeve 22 and the depending base cone 8 to be drawn inwards. Tension spring 27 joining base cone 8 and frame 3 ensures that frame 3 is drawn in with base cone 8. In the same way retraction of piston/cylinder device 16 also causes base cone 9 and frame 4 to be drawn inwards: this is achieved by piston rod 18 drawing in slidable member 19 which in turn pushes sleeve 30 and its attached base cone 9 inwards. Tension spring 35 joining this base cone and frame 4 ensures that frame 4 is pulled inwards with cone 9.

Thus the slab support members 1 and 2 are withdrawn from contact with the heat insulating lining which remains firmly in contact with the mould walls and frames 3 and 4 are telescoped together, rods 12 and 13 on frame 4 sliding inwards in sleeves 10 and 11 on frame 3. This continues until the ends of rods 12 and 13 abut against the ends of sleeves when frames 3 and 4 can be moved no further inwards. The continued retraction of piston/cylinder 16 draws together the slidable members 17 and 19, in frames 3 and 4, and their associated sleeves 22 and 30 move in their slots 23 and 31. Thus base cones 8 and 9 which hang from sleeves 22 and 30 are drawn further inwards with extension of the springs 27 and 35. By this continued retraction, base cones 8 and 9 are drawn further inwards and from underneath the heat-insulating slabs. Then the apparatus may be lifted clear of the mould without the base cones fouling the slabs and wedges in the mould.

I claim as my invention:

1. In an apparatus for applying a hot top lining in an ingot mould or ingot mould head box which comprises a pair of slab support members each having two faces adapted to support an L-shaped slab of hot top lining material such that the L-shaped slabs are supported outside the members in the form of a rectangle, means for moving the members towards one another and apart to decrease or increase the size of the rectangle, supports for corner wedges located above the gap between supported L-shaped slabs when the members are in their most separated position, and means for applying pressure to the tops of the corner wedges to urge them into the gaps between the L-shaped slabs, the improvement which comprises said corner wedge supports being mounted on two opposed corners of one of the slab support members, means for releasing a corner wedge held in a said corner wedge support to allow it to drop with gravity, and providing, mounted on the said one of the slab support members, a bar outwardly extendable, pressure plates on the ends of the bar, and piston/cylinder means adapted to draw the bar downwardly with the pressure plates extended to force wedges dropped from their supports downwards into the gaps between the L-shaped slabs.

2. Apparatus according to claim 1 wherein each slab support member comprises a substantially L-shaped member mounted pivotally about a vertical axis.

3. Apparatus according to claim 1 and including located below the slab support members, guide members to facilitate the insertion of the apparatus in the mould or headbox.

4. Apparatus according to claim 1 and including located below the slab support members, guide members to facilitate the insertion of the apparatus in the mould or headbox wherein the guide members are in the form of the split halves of a truncated pyramid, the upwards facing base of each pyramid half serving to aid support a hot top lining slab.

5. Apparatus according to claim 4 wherein each pyramid half is supported pivotally about a vertical axis.

6. Apparatus according to claim 1 and comprising castor supports adapted to rest on the head of an ingot mould or head box when the apparatus is lowered therein.

7. Apparatus according to claim 1 wherein the piston/cylinder means comprises two spaced piston/cylinder devices and the bar is connected to each piston/cylinder device pivotally about a horizontal axis.

* * * * *